US006311390B1

(12) United States Patent
Abe et al.

(10) Patent No.: US 6,311,390 B1
(45) Date of Patent: Nov. 6, 2001

(54) METHOD OF PRODUCING THERMISTOR CHIPS

(75) Inventors: Yoshiaki Abe; Takahiko Kawahara; Toshiharu Hirota, all of Shiga (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/415,450

(22) Filed: Oct. 8, 1999

(30) Foreign Application Priority Data

Nov. 19, 1998 (JP) ..... 10-328954

(51) Int. Cl.[7] ..... H01C 7/02

(52) U.S. Cl. ..... 29/612; 338/22 R; 338/314; 338/322

(58) Field of Search ..... 29/610, 610.1; 338/22 R, 225, 22 D, 203

(56) References Cited

U.S. PATENT DOCUMENTS

| | | | | |
|---|---|---|---|---|
| 5,488,348 | | 1/1996 | Asida et al. . | |
| 5,493,266 | | 2/1996 | Sasaki et al. . | |
| 6,020,808 | * | 2/2000 | Hogge | 338/22 R |
| 6,040,755 | * | 3/2000 | Abe | 338/22 R |
| 6,157,289 | * | 12/2000 | Kojima | 338/22 R |

FOREIGN PATENT DOCUMENTS

| | | | | |
|---|---|---|---|---|
| 405036501 | * | 2/1993 | (JP) | 29/612 |
| 405335113 | * | 12/1993 | (JP) | 29/612 |

* cited by examiner

*Primary Examiner*—Carl J. Arbes
*Assistant Examiner*—Sean Smith
(74) *Attorney, Agent, or Firm*—Coudert Brothers

(57) ABSTRACT

Thermistor chips are produced by first obtaining elongated strips made of a sintered ceramic plate having a specified resistance-temperature characteristic and having thereon a plurality of mutually parallel grooves extending perpendicularly to its direction of elongation. On each of these strips, ohmic electrodes are formed, one extending continuously from one of its main surfaces to one of its side surfaces and another extending continuously from the other oppositely facing main surface to the opposite side surface. This may done by covering the strip completely with an electrically conductive film and separating it into two areal parts by forming a longitudinally extending slit on each of the main surfaces. These strips are then stacked one on top of another by aligning the grooves on each of these strips and adhesively attached together with a glass paste in between. The layered structure thus obtained is broken up along the aligned grooves to obtain individual units of which newly exposed surfaces may later be covered by an electrically insulating material.

16 Claims, 4 Drawing Sheets

METHOD OF PRODUCING THERMISTOR CHIPS

BACKGROUND OF THE INVENTION

This invention relates to a method of producing thermistor chips and more particularly to thermistor chips of the type having adhesively attached layers.

There have been demands to both miniaturize thermistor chips and to reduce their resistance values in order to lower the power loss due to a voltage drop. In view of these demands, Japanese Patent Publication Tokkai 6-267709 disclosed thermistor chips of a layered structure obtained by stacking up one on top of another a plurality of elements each having a positive temperature characteristic and having electrodes formed on both its main surfaces, attaching them by using an electrically conductive adhesive and connecting the individual elements in parallel. Thermistor chips with a low resistance value can be obtained by structuring them in this manner.

When thermistor chips with such a structure are to be produced, not only is it necessary to attach the individual elements with an adhesive such that their electrodes overlap each other but also to keep the electrodes on each element in a mutually insulated relationship. Thus, the structure had to be designed such that the conductive adhesive would not be applied to the area between the electrodes or an electrically insulating material had to be applied. Moreover, since it is necessary to stack up many elements with differently shaped electrodes, there was a high probability of increasing the production cost.

In view of the above, it may be considered to produce a thermistor by stacking up a plurality of elements through an electrically insulating material. Such a thermistor may be formed by preparing elements each having one ohmic electrode which covers almost entirely one of the main surfaces and extends over one of a side surfaces to the other main surface and another ohmic electrode which covers the other main surface almost entirely and extends over another side surface to the first main surface. These elements are stacked one on top of another in a main surface-to-main surface relationship through an insulating material such as a glass material in between. Outer electrodes are formed over the parts of these ohmic electrodes exposed on the side surfaces.

Thermistor chips of this type are advantageous in that the area over which the adhesive should be applied can be strictly controlled while an attempt is being made to reduce the resistance value. Moreover, since there is no need to use two kinds of adhesive agents, the structure can be made simpler. Since elements of only one kind are to be stacked up, the production cost can be reduced.

One of the methods for producing such thermistors would be to first prepare an ohmic electrode on mother substrates in the form of a green sheet, stacking them with an electrically insulating material inserted in between, cutting it into individual element and then subjecting them to a firing process. With such a method, however, electric charges move from the electrode material into the elements and generate voltage differences, and a barrier layer is generated between the electrode and the element. Since this functions as an electrical barrier, it works against the intended purpose of obtaining a thermistor with a reduced resistance.

According to a method considered for preventing the formation of such a barrier layer, ohmic electrodes are formed on the mother substrates which have already undergone a firing process, thereafter they are stacked with an insulating material in between and then a dicing blade or the like is used to cut it into individual elements. This method, however, is not economically feasible because the useful lifetime of a blade is not sufficiently long and this adversely affects the cost of production.

In view of the above, another method may be considered whereby ohmic electrodes are formed on a mother substrate having breaking grooves for making it easier to break it and after it is broken up along these grooves into individual elements, they are stacked up with an insulating material in between to form a thermistor chip having a layered structure. Such a method, however, could not produce dimensionally accurate products and hence the yield of "good" products was low because the stacking takes place after the mother substrate is broken up into elements.

SUMMARY OF THE INVENTION

It is therefore an object of this invention to provide a new method of producing thermistor chips which is easy to carry out and can produce products with a high dimensional accuracy at a high rate of yield.

A method embodying this invention, with which the above and other objects can be accomplished, starts with the step of preparing a mother substrate which is made of a sintered ceramic material shaped like a strip and having a specified resistance-temperature characteristic and a plurality of mutually parallel grooves. On each of these strips, an ohmic electrode is formed so as to extend continuously from one of its main surfaces to one of its side surfaces and another ohmic electrode extending continuously from the other oppositely facing main surface to another side surface. This may done by covering the strip completely with an electrically conductive film, say, by plating, vapor deposition or sputtering, and separating this film into two areal parts by forming a longitudinally extending slit in the film on each of the main surfaces, say, by sandblasting or laser trimming. These strips are then stacked one on top of another by aligning the grooves on each of these strips and adhesively attached together with an electrically insulating material in between. A glass paste may be used for this purpose in view of its resistance against heat, insulation characteristics and its coefficient of thermal expansion. The layered structure thus obtained is broken up along the aligned grooves on the stacked strips to obtain individual units.

These ohmic electrodes on the stacked strips are mutually separated but if the portions of the electrodes on each of the side surfaces are connected together, the ohmic electrodes on different strips are connected in parallel. Thus, a thermistor chip with a low resistance value can be obtained.

If an electrically insulating layer is formed each on the top and bottom surfaces of the layered structure and the side surfaces of the individual units, which became exposed as the layered structure was broken up, are covered similarly with an electrically insulating material, accidental contacts between the ohmic circuits on opposite sides can be prevented and thermistor chips with a higher reliability can be obtained.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
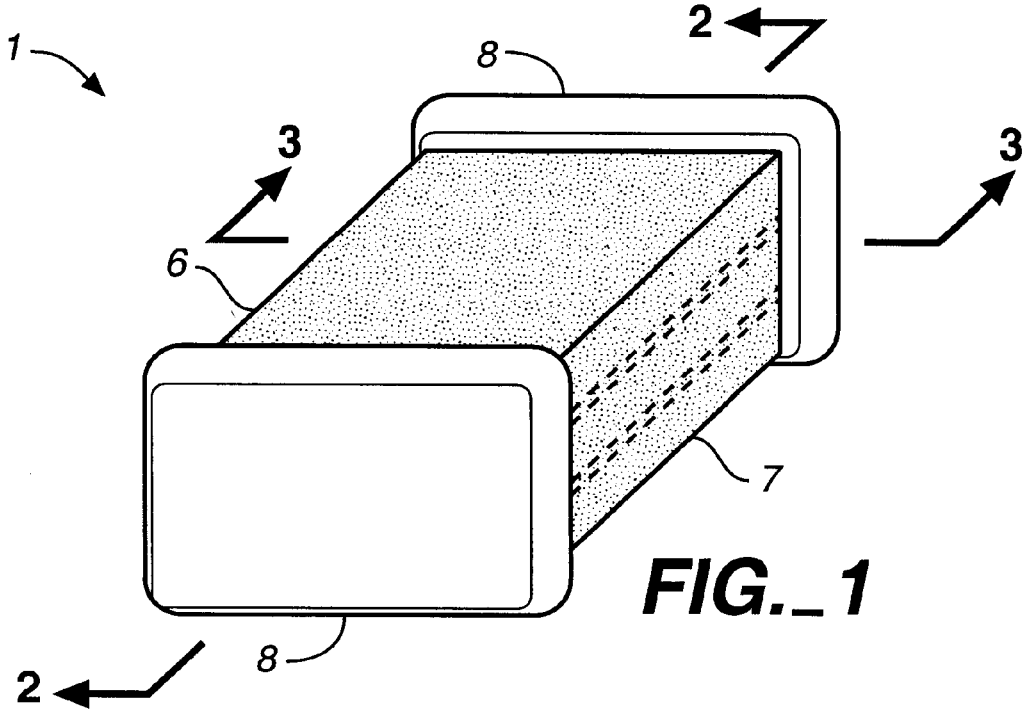
FIG. 1 is a diagonal view of a thermistor chip produced by a method embodying this invention.
Figure 2:
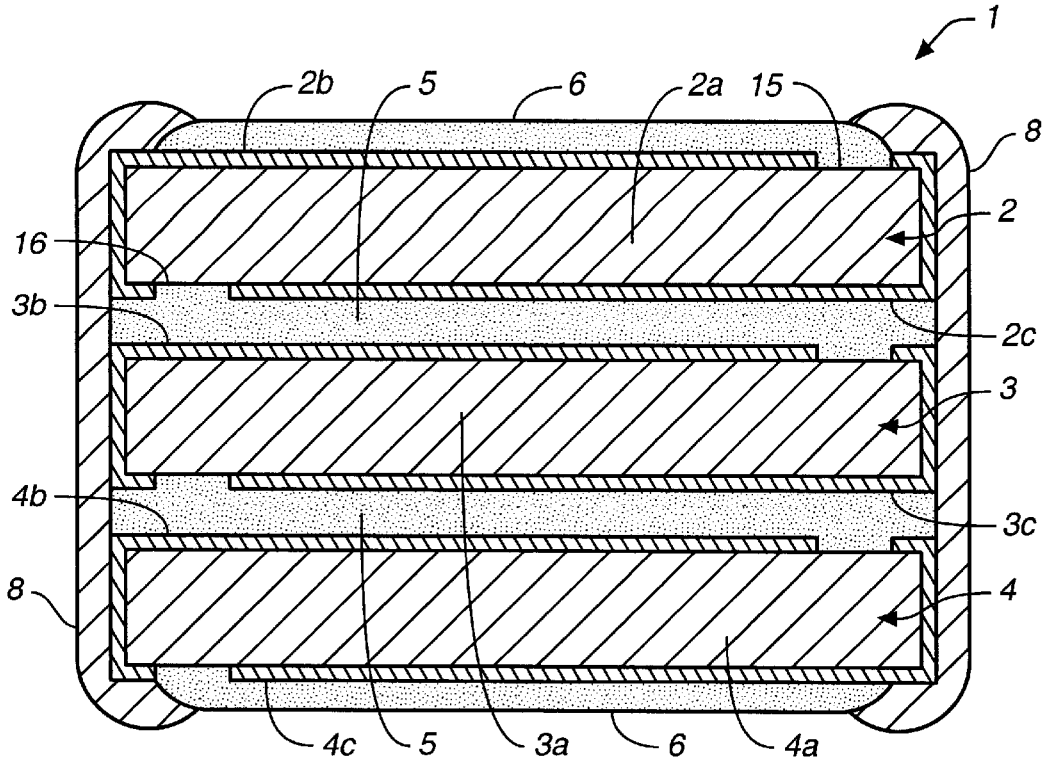
FIG. 2 is a sectional view of the thermistor chip of FIG. 1 taken along line 2—2 of FIG. 1.
Figure 3:
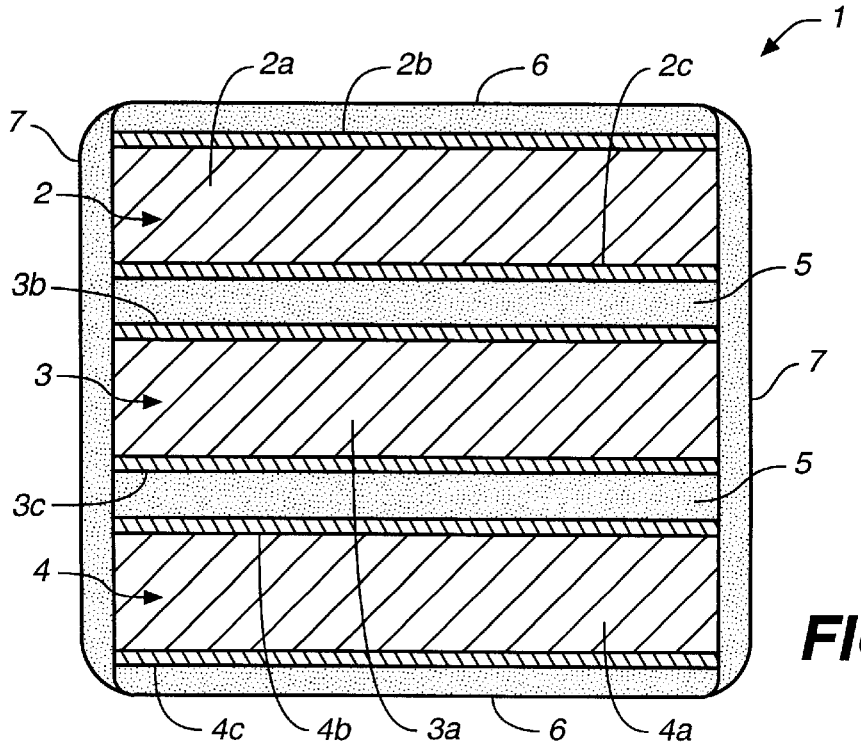
FIG. 3 is a sectional view of the thermistor chip of FIG. 1 taken along line 3—3 of FIG. 1.

FIGS. 1, 2 and 3 show an example of thermistor chip 1 produced by a method embodying this invention, formed by stacking up three units 2, 3 and 4 one on top of another. In order to obtain a thermistor chip with an even lower resistance value, a larger number of such units may be stacked up.

Each of the units 2, 3 and 4 comprises a ceramic body 2*a*, 3*a* or 4*a* made of a ceramic material having a specified resistance-temperature characteristic. A set of ohmic electrodes 2*b*, 3*b* and 4*b* is formed each so as to cover a major portion of one of the main surfaces (the "first main surface") of a corresponding one of these ceramic bodies 2*a*, 3*a* and 4*a* and to extend over one of its side surfaces to the opposite main surface (the "second main surface"). Another set of ohmic electrodes 2*c*, 3*c* and 4*c* is formed each so as to cover a major portion of the second main surface of the corresponding one of the ceramic bodies 2*a*, 3*a* and 4*a* and to extend over another of its side surfaces to its first main surface. These ohmic electrodes 2*b*, 3*b*, 4*b*, 2*c*, 3*c* and 4*c* may be formed by applying Ni, Cr, Al or the like, for example, by plating, vapor deposition or sputtering. The units 2, 3 and 4 are adhesively attached together with an electrically insulating material 5, such as lead borosilicate glass, inserted therebetween to form the thermistor chip 1. Covers 6 and 7 made of an electrically insulating material are formed on the externally exposed portions of the upper, lower and side surfaces of the thermistor chip 1. Outer electrodes 8, such as of Ag, for soldering are formed so as to electrically connect with the portions of the ohmic electrodes 2*b*–4*b* and 2*c*–4*c* exposed on the side surfaces of the thermistor chip 1 such that the ohmic electrodes 2*b*–4*b* are mutually in an electrically connected relationship and so are the ohmic electrodes 2*c*–4*c* among themselves.

Next, FIG. 4 is referenced to describe a method of producing the thermistor chip 1.

Figure 4A:
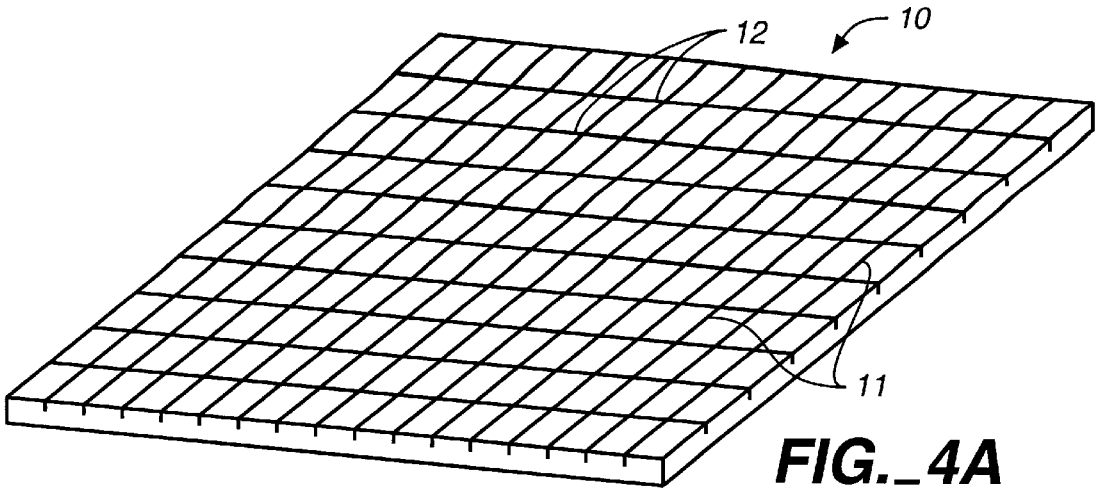
FIGS. 4A, 4B, 4C, 4D, 4E, 4F, 4G and 4H, which are together referred to as FIG. 4, are diagonal views of the thermistor chip of FIG. 1 at various stages of its production by a method embodying this invention.

First, a planar mother substrate 10 is prepared as shown in FIG. 4A. The mother substrate 10 may be obtained by forming breaking grooves 11 and 12 in mutually perpendicular directions respectively at intervals of 5.4 mm and 3.8 mm, for example, on the upper surface of a ceramic green sheet with thickness about 0.25 mm. Such grooves 11 and 12 may be formed by using a mold or by means of a laser scriber. The depth of the grooves 11 and 12 should preferably be 0.4–0.8 times the thickness of the green sheet. The mother substrate 10 is formed by baking such a green sheet at about 1300° C. After the baking, the thickness of the mother substrate 10 becomes about 0.2 mm and the intervals between the grooves 11 and 12 become about 4.5 mm and 3.2 mm.

Figure 4B:
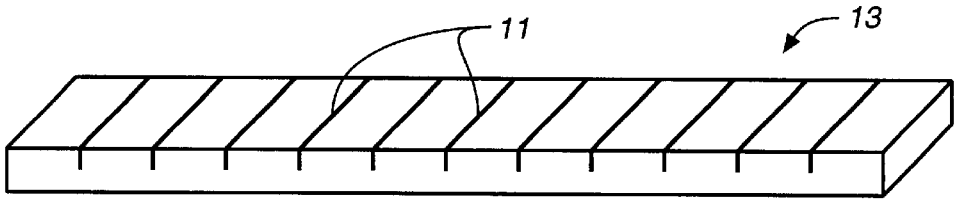
Figure 4C:
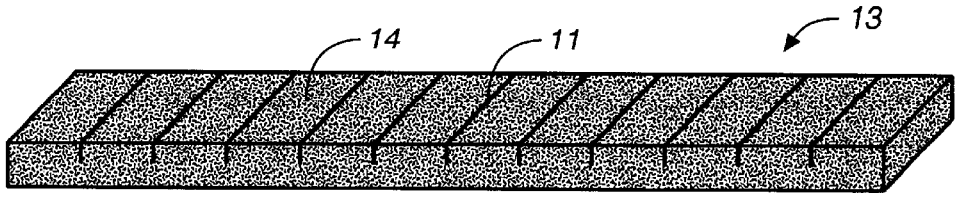

FIG. 4B shows a strip 13 obtained by breaking the mother substrate 10 along the grooves 12, having grooves 11 on its upper surface at intervals, say, of 3.2 mm. Next, an electrically conductive film 14 for forming ohmic electrodes, say, of Ni is formed on all surfaces of this strip 13, inclusive of the interior of the grooves 11, by electroless plating, as shown in FIG. 4C.

Figure 4D:
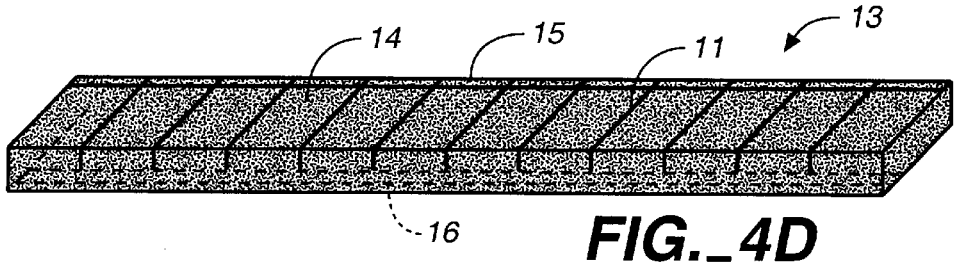

Next, longitudinally extending slits 15 and 16 are formed on the main surfaces of the strip 13, as shown in FIG. 4D, by removing corresponding portions of the film 14, say, by sandblasting or by laser trimming, such that the film 14 is separated to mutually separated areal portions. As shown in FIG. 2, the slit 15 on the upper surface is formed much closer to one of the side edges of the strip 13 while the slit 16 on the lower surface is formed much closer to the other of the side edges of the strip 13. This is done so as to make as large portions as possible of the films 14 will be facing opposite each other between the upper and lower surfaces of the strip 13 and to thereby reduce the resistance value therebetween.

Figure 4E:
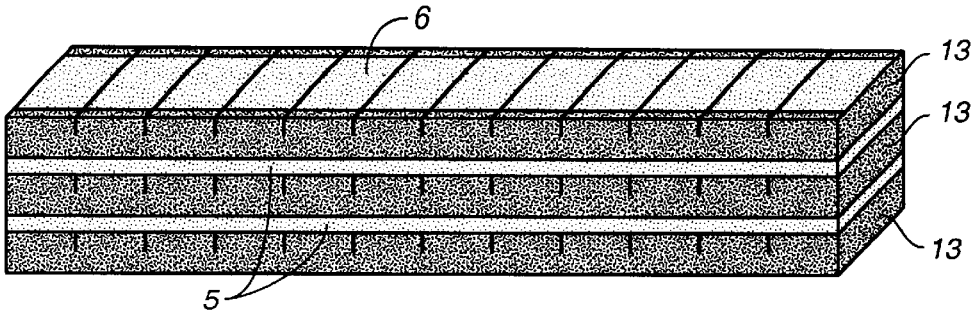

Next, a plurality of (three, in this example) strips as shown in FIG. 4D are stacked and pasted together one on top of another by means of an electrically insulating material 5 such as a lead borosilicate glass paste and are then dried to obtain a layered structure. If the stacking is done by aligning both end parts of the strips 13, their grooves 11 thereon are also aligned accurately in the direction of their thickness. An electrically insulating material 6 is thereafter applied to longitudinally elongated center portions of both the upper and lower surfaces of the layered structure so as to cover not only the film 14 but also the areas where slits 15 and 16 have been formed, as shown in FIG. 4E.

Figure 4F:
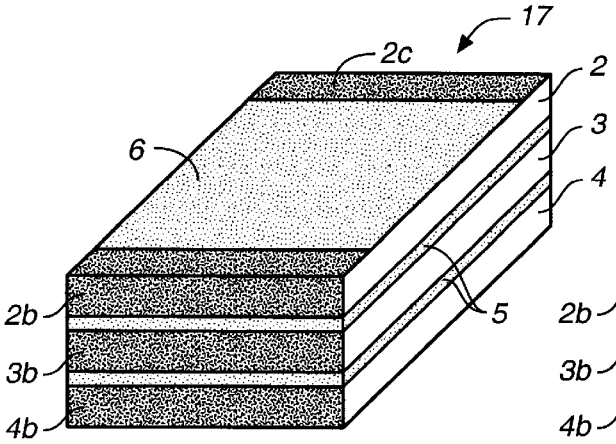
Figure 4G:
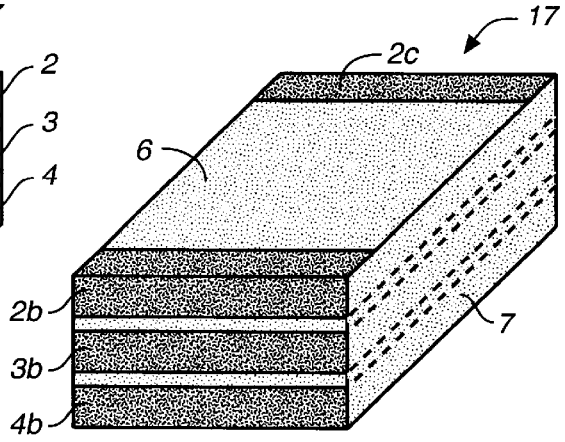
Figure 4H:
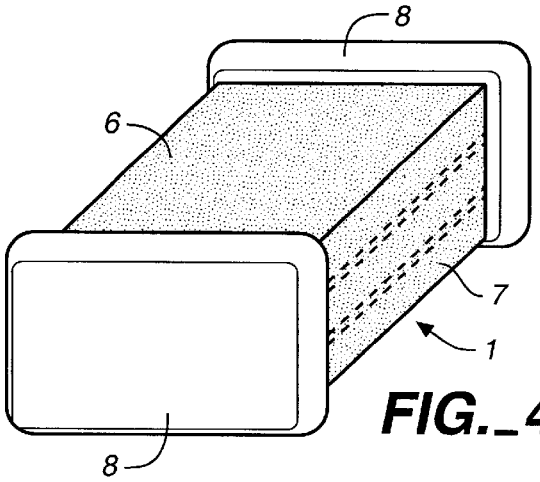

The layered structure thus prepared is then broken up along the grooves 11 to obtain individually separated units 17. The breaking can be effected simultaneously. Since the grooves 11 are accurately aligned in the direction of the thickness of the layered structure, the individual units 17 can be obtained with smooth side surfaces along which the breaking has taken place. Because the electrically conductive film 14 was partially inside the grooves 11, as explained above, the insulating material 5 is effectively prevented from invading the interior of the grooves 11. Thus, the insulating material 5 has no adverse effect on the breaking of the layered structure into the units 17. It is to be noted, as shown in FIG. 4F, that the ohmic electrodes 2*b*–4*b* and 2*c*–4*c* are exposed to the exterior on the side surfaces of the unit 17. Thereafter, a cover 7 made of an electrically insulating material is formed, as shown in FIG. 4G, on each of the side surfaces of the unit 17 which came to be exposed by the breaking of the layered structure. Finally, outer electrodes 8 for being soldered to a circuit board are formed over the end portions of the ohmic electrodes 2*b*–4*b* and 2*c*–4*c* exposed to the exterior on both side surfaces of the unit 17, as shown in FIG. 4H, to obtain the thermistor chip 1 as a finished product. The outer electrodes 8 may be formed by any of the known prior art methods such as by baking Ag, plating (Ni—Sn, Ni—Sn—Sn/Pb, etc.) or sputtering (Monel-Ag-solder, Ag-solder, etc.)

By a method embodying this invention, as described above, the rate of producing dimensionally inaccurate thermistor chips can be significantly reduced, as compared to the prior art method of breaking up into individual units first and then stacking and pasting them together. The present inventors experimented and succeeded by producing 10,000 thermistor chips by reducing the failure ratio down to 0%.

Although the invention has been described above by way of a single example but this example is not intended to limit the scope of the invention. Many modifications and variations are possible within the scope of the invention. It goes without saying that this method can be applied to the production of both positive and negative characteristic thermistor chips. It is to be noted that the outer electrodes 8 are not indispensable, and their functions may be served by the ohmic electrodes 2*b*–4*b* and 2*c*–4*c*. Another method of forming the two mutually separated sets of ohmic electrodes would be to form a mask at the position of each of the slits 15 and 16, to form an electrode all over by plating, vapor deposition or sputtering and then to remove the mask.

What is claimed is:

1. A method of producing thermistor chips, said method comprising the steps of:

obtaining strips of a mother substrate each elongated in a longitudinal direction, made of a sintered ceramic plate having a specified resistance-temperature characteristic, and having a mutually oppositely facing pair of first and second main surfaces and a pair of first and second side surfaces extending between said first and second main surfaces, said first main surface having formed thereon a plurality of mutually parallel grooves extending perpendicularly to said longitudinal direction;

forming a first ohmic electrode which extends continuously from said first main surface to said first side surface and a second ohmic electrode which extends continuously from said second main surface to said second side surface;

stacking a plurality of said strips one on top of another by aligning the grooves of said strips and adhesively attaching said strips together with an electrically insulating material to thereby obtain a layered structure;

breaking up said layered structure along said aligned grooves to thereby obtain individual units.

2. The method of claim 1 wherein said first and second ohmic electrodes are formed by the steps of:

covering said strip completely with an electrically conductive film; and separating said film into two parts by forming in said longitudinal direction a slit in said film on said first main surface and another slit in said film on said second main surface.

3. The method of claim 1 further comprising the steps of:

forming an electrically insulating layer each on a top surface and a bottom surface of said layered structure;

covering side surfaces of individual units, which became exposed as said layered structure was broken up, with an electrically insulating material.

4. The method of claim 2 further comprising the steps of:

forming an electrically insulating layer each on a top surface and a bottom surface of said layered structure;

covering side surfaces of individual units, which became exposed as said layered structure was broken up, with an electrically insulating material.

5. The method of claim 1 further comprising the step of forming a first outer electrode and a second outer electrode on each of said unit, said first outer electrode contacting a portion of said first ohmic electrode which is on said first side surface and a second outer electrode contacting a portion of said second ohmic electrode which is on said second side surface.

6. The method of claim 2 further comprising the step of forming a first outer electrode and a second outer electrode on each of said unit, said first outer electrode contacting a portion of said first ohmic electrode which is on said first side surface and a second outer electrode contacting a portion of said second ohmic electrode which is on said second side surface.

7. The method of claim 3 further comprising the step of forming a first outer electrode and a second outer electrode on each of said unit, said first outer electrode contacting a portion of said first ohmic electrode which is on said first side surface and a second outer electrode contacting a portion of said second ohmic electrode which is on said second side surface.

8. The method of claim 4 further comprising the step of forming a first outer electrode and a second outer electrode on each of said unit, said first outer electrode contacting a portion of said first ohmic electrode which is on said first side surface and a second outer electrode contacting a portion of said second ohmic electrode which is on said second side surface.

9. The method of claim 1 wherein said mother substrate has grooves formed in longitudinal and perpendicular directions and said strips are obtained by breaking along the grooves in said longitudinal direction.

10. The method of claim 2 wherein said mother substrate has grooves formed in longitudinal and perpendicular directions and said strips are obtained by breaking along the grooves in said longitudinal direction.

11. The method of claim 3 wherein said mother substrate has grooves formed in longitudinal and perpendicular directions and said strips are obtained by breaking along the grooves in said longitudinal direction.

12. The method of claim 4 wherein said mother substrate has grooves formed in longitudinal and perpendicular directions and said strips are obtained by breaking along the grooves in said longitudinal direction.

13. The method of claim 5 wherein said mother substrate has grooves formed in longitudinal and perpendicular directions and said strips are obtained by breaking along the grooves in said longitudinal direction.

14. The method of claim 6 wherein said mother substrate has grooves formed in longitudinal and perpendicular directions and said strips are obtained by breaking along the grooves in said longitudinal direction.

15. The method of claim 7 wherein said mother substrate has grooves formed in longitudinal and perpendicular directions and said strips are obtained by breaking along the grooves in said longitudinal direction.

16. The method of claim 8 wherein said mother substrate has grooves formed in longitudinal and perpendicular directions and said strips are obtained by breaking along the grooves in said longitudinal direction.

* * * * *